US005442148A

United States Patent [19]

Hensler

[11] Patent Number: 5,442,148

[45] Date of Patent: Aug. 15, 1995

[54] EXHAUST MUFFLER FOR OUTBOARD MOTORS

[75] Inventor: Roy F. Hensler, Clearwater, Fla.

[73] Assignee: Flush Muffler, Inc., Pinellas Park, Fla.

[21] Appl. No.: 251,256

[22] Filed: May 31, 1994

[51] Int. Cl.[6] ..... F01N 7/12

[52] U.S. Cl. ..... 181/235; 181/228

[58] Field of Search ..... 181/235, 233, 237, 228, 181/254, 264, 265, 282, 283; 440/89; 60/310

[56] References Cited

U.S. PATENT DOCUMENTS 4,601,666 7/1986 Wood, Jr. ..... 440/89

*Primary Examiner*—Khanh Dang

*Attorney, Agent, or Firm*—Harold D. Shall

[57] ABSTRACT

An exhaust muffler for outboard motors which is fastened to the rear end of the propeller hub and directs the motor's exhaust back into the hub of the propeller and out through the front of the propeller and the bypass exhaust ports of the motor. The muffler includes an elastomeric member and a blocking member with the blocking member having pressure relief mechanism therein.

10 Claims, 2 Drawing Sheets

EXHAUST MUFFLER FOR OUTBOARD MOTORS

BACKGROUND OF THE INVENTION

1. Field of the Invention

This invention relates to exhaust mufflers for outboard motors generally and more particularly to such muffler for use when the motor is being flushed with fresh water.

2. Description of the Prior Art

After an engine has been used in salt water or in other situations where contaminants may have entered the cooling system and is being flushed, or at such times as the engine is being run out of water with water being supplied to the water inlet ports by a hose or the like, the exhaust from the modern engine is directed from the engine out through the rear of propeller hub and the exhaust noise is not muffled and is substantial. When the engine is in the water, the noise of the exhaust is muffled by the water and also the water forces some of the exhaust out of the exhaust by-pass ports thereby also muffling the engine noise. No prior art devices were found to reduce such engine noise when the engine was being flushed or being run out of the water for other purposes.

SUMMARY OF THE INVENTION

The present invention is an exhaust muffler for outboard motors which is fastened to the rear end of the hub of the motor's propeller and directs the exhaust back into the propeller whereby part of the exhaust vents through the forward end of the propeller and the remainder exhausts thorough the exhaust by-pass ports of the engine. This substantially reduces or muffles the exhaust noise produced by the engine. The exhaust muffler also includes a pressure relief mechanism so that when the engine surges, backfires or for any other reason provides a sudden increase in exhaust pressure, the relief mechanism will release the increased pressure without damaging the engine or blowing the exhaust muffler off of the propeller hub.

DETAILED DESCRIPTION OF THE PREFERRED EMBODIMENT

Figure 1:
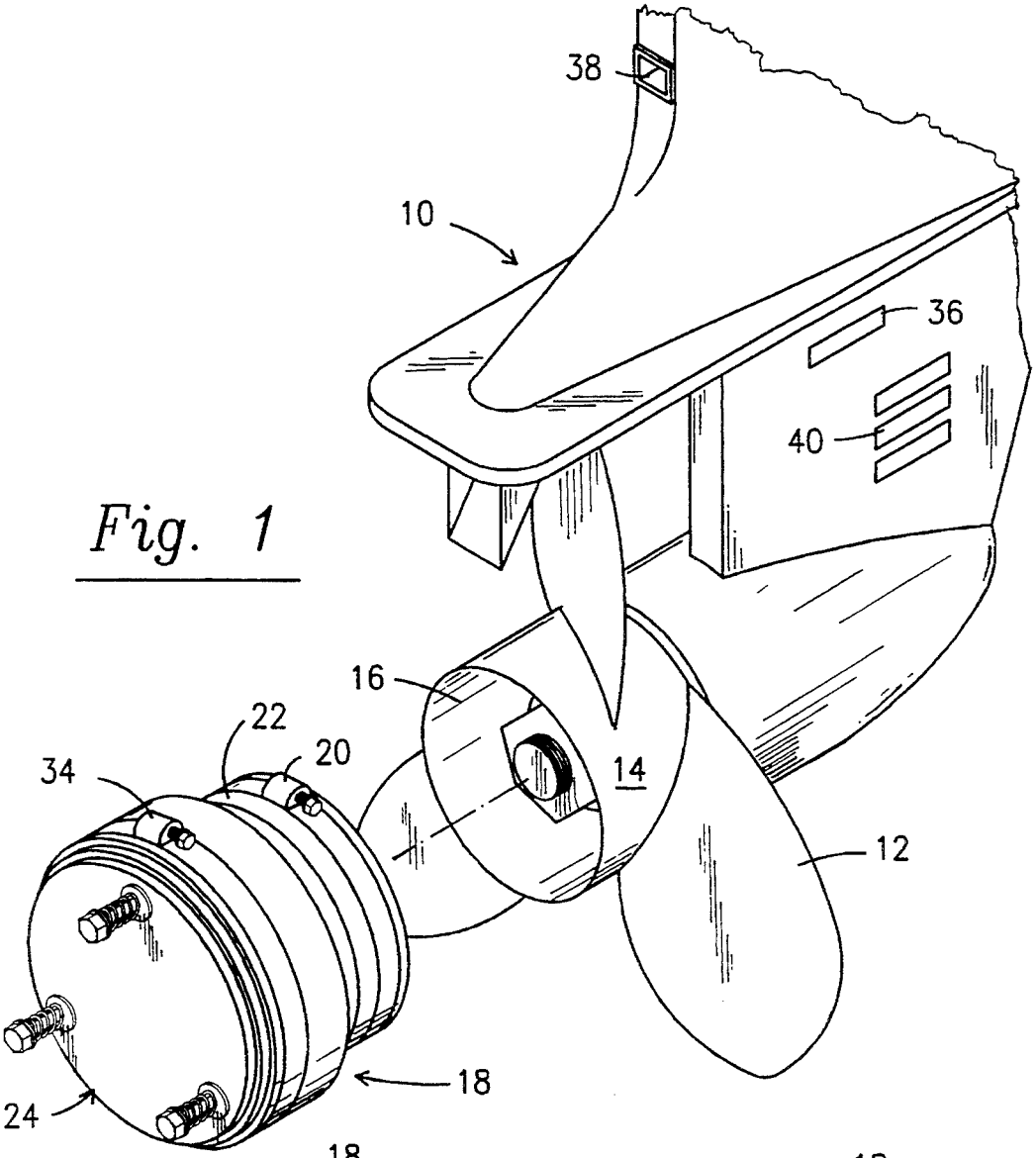
FIG. 1 is a perspective view of the lower portion of an outboard motor having a propeller thereon with the exhaust muffler of this invention about to be placed thereon.
Figure 2:
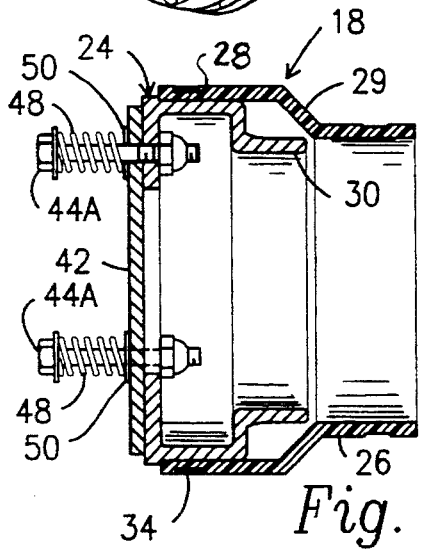
FIG. 2 is a longitudinal cross sectional view of the exhaust muffler of this invention with the relief mechanism installed in the larger end.
Figure 3:
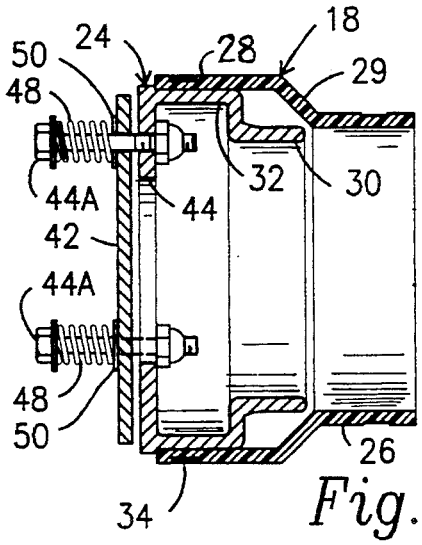
FIG. 3 is a view like FIG. 2 with the relief mechanism in its pressure relief position.

Referring to FIGS. 1–3 and 5, the lower end of an outboard motor is shown generally at 10 and has mounted thereon a propeller 12 having a hub 14, with the hub having an exhaust discharge opening 16 therein. An exhaust muffler 18 is generally shown at 18 and in FIG. 1 is shown in a position where it is about to be placed on the hub 14 and in FIG. 5 the muffler 18 is shown mounted on the hub of the propeller 12. When so mounted on the hub 12, a screw clamp 20 on the smaller end of the muffler is tightened to secure the muffler on the hub.

The muffler 18 is made of a securing portion 22, made of an elastomeric material such as neoprene, and a blocking portion 24, made of metal such as aluminum, which covers the end of the securing portion 22 and has a smaller cylindrical end 26 on the right end thereof and a larger cylindrical end 28 on the left end thereof connected by an intermediate section 29, while the blocking portion 24 has a smaller cylindrical portion 30 on the right end thereof and a larger cylindrical portion 32 connected thereto which is received in the larger cylindrical end 28 and secured therein by a screw clamp 34.

Figure 4:
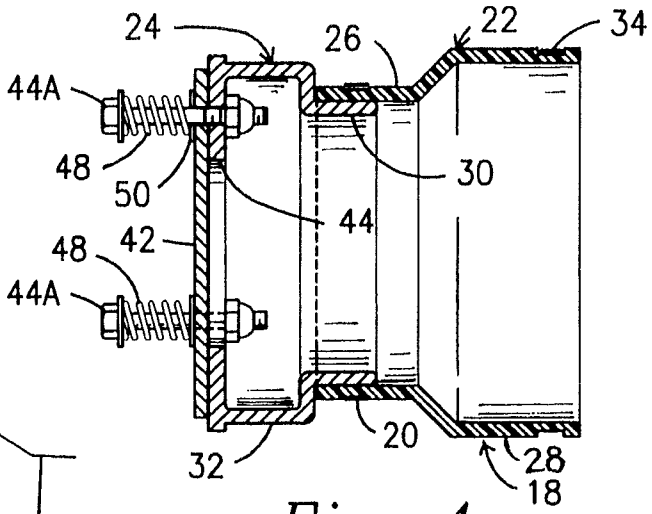
FIG. 4 is a view like FIG. 2 with the relief mechanism installed in the smaller end.
Figure 6:
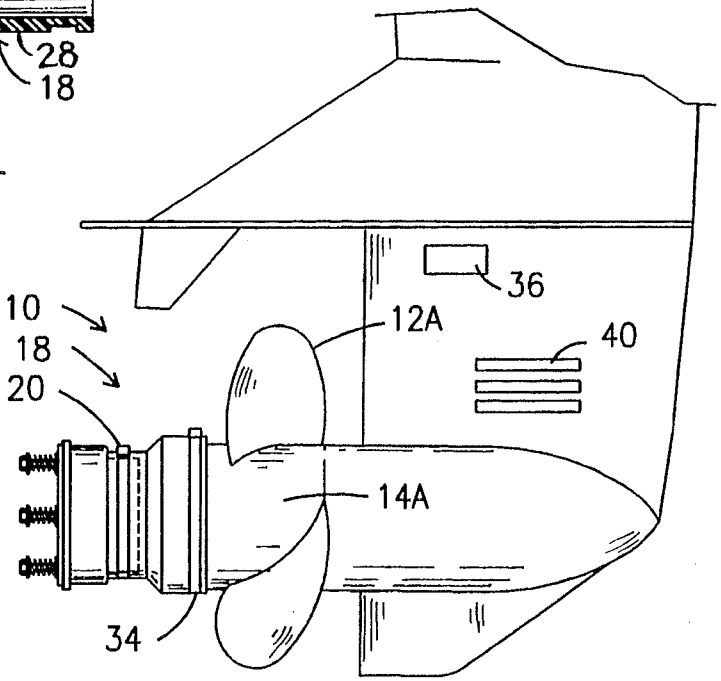
FIG. 6 is a view like FIG. 5 with the larger end of the exhaust muffler installed on the hub of the propeller.

As seen in FIGS. 4 and 6, the smaller portion 30 of the blocking portion 24 can be inserted into the smaller cylindrical end 26 of the securing portion 22 of the muffler 18 with the larger cylindrical portion 32 extending from the securing portion and with the screw clamp 20 securing the same together. The muffler 18 is shown secured on the end of a propeller 12A having a hub 14A larger than the hub of the propeller 12 whereby the muffler 18 is adaptable to propellers of various sizes.

Figure 5:
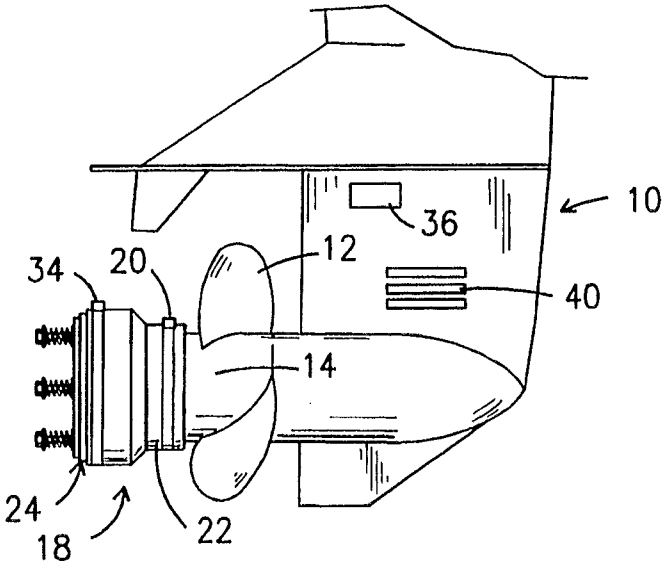
FIG. 5 is a side elevational view of the lower end of an outboard motor with the smaller end of the exhaust muffler installed on the hub of the propeller.

With the muffler in its exhaust muffling position, as seen in FIGS. 5 and 6, the exhaust which normally is expelled out through the propeller hub, is directed back into the propeller and out through exhaust by pass ports 36 and 38 while water is being supplied into the motor through the water inlet openings 40 by conventional flushing means.

The blocking means 24 includes a pressure relief means in the form of an annular plate 42 which overlies an opening 44 formed in the large end 32 of the blocking means. The plate 42 is secured to the end 32 by four elongated bolts 44A which pass through registering openings in the plate 42 and the large end 32 and which bolts 44A have adjustable nuts 46 on the inner end thereof, and a coiled compression spring 48 surrounding each bolt and compressed between the head of the bolt and a washer 50 disposed between the inner end of the spring and the larger end 32. The plate 42 serves as a pressure relief in the event of a sudden pressure build up within the exhaust system of the motor.

Although the above description relates to a presently preferred embodiment, numerous changes can be made therein without departing from the scope of this invention as claimed in the following claims.

What is claimed is:

1. An exhaust muffler for an outboard motor which has its exhaust out through the hub of the propeller, comprising a propeller having a hub, an exhaust muffler connected to said propeller, said exhaust muffler including directing means for directing the engines exhaust back into said hub of said propeller and said exhaust muffler including securing means for securing said directing means to said propeller.

2. An exhaust muffler according to claim 1 including pressure relief means carried by said exhaust muffler for allowing increases in exhaust pressure to pass thereby.

3. An exhaust muffler according to claim 1 wherein said securing means includes a first and a second securing member carried by said exhaust muffler with one of said securing members being larger than the other.

4. An exhaust muffler for an outboard motor which has its exhaust out through the hub of the propeller comprising a propeller having a hub, an exhaust muffler connected to said propeller, said exhaust muffler including a cylindrical elastomeric member having a first end secured to said hub of said propeller and a second end remote from said first end, and blocking means carried by said elastomeric member for blocking the outflow of exhaust from the second end of said elastomeric member.

5. An exhaust muffler according to claim 4 wherein said blocking means carried by said exhaust muffler includes pressure relief means for allowing increases in exhaust pressure to pass thereby.

6. An exhausted muffler for an outboard motor which has its exhaust out through the hub of the propeller of the motor comprising a propeller having a hub, an exhaust muffler connected to said propeller, said exhaust muffler comprising an elastomeric member having a first cylindrical portion and a second cylindrical portion larger than said first cylindrical portion, a first and a second annular screw clamp surrounding said first and said second portion, and, blocking means carried by said elastomeric member for blocking the flow through said elastomeric member of the motor's exhaust.

7. An exhaust muffler according to claim 6 wherein said blocking means includes pressure relief means carried by said exhaust muffler for allowing increases in exhaust pressure to pass thereby.

8. An exhaust muffler according to claim 6 wherein said blocking means has a first and second interconnected cylindrical member, with said first cylindrical member being receivable in said first cylindrical portion and said second cylindrical member being receivable in said second cylindrical portion (and said blocking means in carried by one of said cylindrical member).

9. An exhaust muffler according to claim 8 wherein said blocking means includes pressure relief means carried by said exhaust muffler for allowing increases in exhaust pressure to pass thereby.

10. An exhaust muffler according to claim 9 wherein said blocking means includes an annular plate and spring means and said spring means secures said annular plate to said one of said cylindrical members.

* * * * *